US010152941B2

(12) United States Patent
Kim

(10) Patent No.: US 10,152,941 B2
(45) Date of Patent: Dec. 11, 2018

(54) DISPLAY APPARATUS AND METHOD EMPLOYING PRE-CHARGING BASED ON IMAGE DATA COMPARISON

(71) Applicant: SAMSUNG DISPLAY CO., LTD., Yongin-Si, Gyeonggi-Do (KR)

(72) Inventor: Bo-Yeon Kim, Seoul (KR)

(73) Assignee: SAMSUNG DISPLAY CO., LTD., Yongin-Si, Gyeonggi-Do (KR)

( * ) Notice: Subject to any disclaimer, the term of this patent is extended or adjusted under 35 U.S.C. 154(b) by 64 days.

(21) Appl. No.: 15/152,612

(22) Filed: May 12, 2016

(65) Prior Publication Data

US 2017/0069269 A1 Mar. 9, 2017

(30) Foreign Application Priority Data

Sep. 4, 2015 (KR) ..... 10-2015-0125313

(51) Int. Cl.
*G09G 3/36* (2006.01)

(52) U.S. Cl.
CPC ... *G09G 3/3688* (2013.01); *G09G 2310/0248* (2013.01); *G09G 2310/0251* (2013.01); *G09G 2320/0252* (2013.01); *G09G 2320/103* (2013.01)

(58) Field of Classification Search
CPC ..... G09G 3/3688; G09G 3/3275; G09G 2310/0248; G09G 2310/0251; G09G 2320/0252; G09G 2330/021; G09G 2310/0286
See application file for complete search history.

(56) References Cited

U.S. PATENT DOCUMENTS 6,914,587 B2 * 7/2005 Kosaka ..... G09G 3/3688 345/215
8,466,868 B2 * 6/2013 Lee ..... G09G 3/3291 345/100
2002/0105492 A1 * 8/2002 Kosaka ..... G09G 3/3688 345/89
2009/0219265 A1 * 9/2009 Lee ..... G09G 3/3291 345/205
2011/0109582 A1 * 5/2011 Masazumi ..... G06F 1/1626 345/173

FOREIGN PATENT DOCUMENTS

KR 1020010102837 11/2001
KR 1020030069652 8/2003

* cited by examiner

*Primary Examiner* — Xuemei Zheng
(74) *Attorney, Agent, or Firm* — F. Chau & Associates, LLC

(57) ABSTRACT

A display apparatus includes a display panel configured to display an image and comprises a plurality of gate lines, a plurality of data lines and a plurality of pixels connected to the plurality of gate lines and the plurality of data lines. A signal comparing circuit may be configured to compare an image data of an image currently being displayed with an image data of an image to be displayed subsequently, and to store a comparison data resulting from a comparison of the image data. A pre-charge controller may be disposed in the display panel and may pre-charge the plurality of data lines with predetermined voltage level based on the comparison data.

20 Claims, 9 Drawing Sheets

DISPLAY APPARATUS AND METHOD EMPLOYING PRE-CHARGING BASED ON IMAGE DATA COMPARISON

CROSS-REFERENCE TO RELATED APPLICATION

This application claims priority under 35 U.S.C. § 119 to Korean Patent Application No. 10-2015-0125313, filed on Sep. 4, 2015 in the Korean Intellectual Property Office (KIPO), the disclosure of which is incorporated by reference herein in its entirety.

TECHNICAL FIELD

Exemplary embodiments of the present inventive concept relate to a display apparatus and method of driving the display apparatus.

DISCUSSION OF RELATED ART

A display device, such as a liquid crystal display ("LCD") and an organic light emitting diode ("OLED") display, generally includes a display panel including a plurality of pixels a plurality of signal lines, a voltage generator, and a data driver. Each pixel may include a switching element. The voltage generator may generate a reference voltage. The data driver generates a plurality of voltages using the reference voltage and applies a data voltage, corresponding to an input image signal among the generated voltages, as a data signal to a data line of the plurality of signal lines.

The LCD typically includes two display panels having a pixel electrode and an opposing electrode, and a liquid crystal layer having dielectric anisotropy interposed therebetween. The pixel electrode is arranged in a matrix form and is connected to a switching element such as a thin film transistor ("TFT") to sequentially receive the data voltage row by row. The opposing electrode is disposed on substantially the entire surface of the display panel and receives a common voltage. The pixel electrode and the opposing electrode are applied with the data and common voltages to generate an electric field in the liquid crystal layer, by adjusting the intensity of the electric field, a transmittance of light passing through the liquid crystal layer is controlled to obtain a desired image.

In the LCD apparatus, a display panel's signal lines include a plurality of gate lines, a plurality of data lines. The plurality of pixels is connected to the gate lines and the data lines.

A driving circuit includes a gate driver configured to drive the gate lines, a data driver configured to drive the data lines and a timing controller configured to control the gate driver and the data driver.

However, when the data driver performs charges all of the data lines, a heating value and a power consumption of the data driver may be increased.

SUMMARY

According to an exemplary embodiment of the present inventive concept, the display apparatus includes a display panel, a signal comparing unit and a pre-charge controller. The display apparatus include a display panel configured to display an image. The display panel includes a plurality of gate lines, a plurality of data lines and a plurality of pixels connected to the gate lines and the data lines. The signal comparing circuit may compare an image data of an image currently being displayed with an image data of an image to be displayed subsequently, and store a comparison data resulting from the comparison. The pre-charge controller may be disposed in the display panel and may pre-charge the data lines with a predetermined voltage level based on the comparison data.

In an exemplary embodiment of the present inventive concept, the signal comparing circuit may include a first storage device, a second storage device and a third storage device. The first storage device may store the image data of the image currently being displayed. The second storage device may store the image data of the image to be displayed subsequently. The third storage device may store a result of a comparing of the image data stored in the first storage device and the second storage device.

In an exemplary embodiment of the present inventive concept, the display apparatus may further include a data driver configured to output a data voltage to the display panel. The signal comparing circuit may be disposed in the data driver.

In an exemplary embodiment of the present inventive concept, the comparison data may identify whether the data lines are pre-charged or not and a voltage level of a pre-charge voltage.

In an exemplary embodiment of the present inventive concept, the pre-charge controller may include a plurality of pre-charge voltage applying switches electrically connected to a plurality of pre-charge voltage applying circuits configured to apply a plurality of pre-charge voltages having different voltage levels. A pre-charge start switch connecting between the pre-charge voltage applying switches and the data lines.

In an exemplary embodiment of the present inventive concept, the display apparatus may further include a shift register configured to control the plurality of pre-charge voltage applying switches based on the comparison data.

In an exemplary embodiment of the present inventive concept, the comparison data may be applied to the plurality of pre-charge voltage applying switches.

In an exemplary embodiment of the present inventive concept, the pre-charge voltage applying circuits may apply two pre-charge voltages having different voltage levels.

In an exemplary embodiment of the present inventive concept, the pre-charge voltage applying circuits may apply three pre-charge voltages having different voltage levels.

In an exemplary embodiment of the present inventive concept, the pre-charge controller may pre-charge the data lines based on a horizontal synchronization signal.

According to an exemplary embodiment of the present inventive concept, a method of driving a display apparatus a display panel configured to display an image and comprising a plurality of gate lines, a plurality of data lines and a plurality of pixels connected to the gate lines and the data lines, a signal comparing circuit, and a pre-charge controller disposed in the display panel. The method may include comparing with the signal comparing circuit an image data of an image currently being displayed with an image data of an image to be displayed subsequently to generate a comparison data. The comparison data may be stored with the signal comparing circuit. The comparison data is applied to the pre-charge controller. A selected pre-charge voltage of a plurality of pre-charge voltages having different voltage levels may be output. The data lines may be pre-charged by using the selected pre-charge voltage in response to a pre-charge control signal.

In an exemplary embodiment of the present inventive concept, the signal comparing circuit may include a first storage device, a second storage device and a third storage device. The first storage device may store the image data of the image currently being displayed. The second storage device may store the image data of the image to be displayed subsequently. The third storage device may store a comparing data of the image data stored in the first storage device and the second storage device as the comparison data.

In an exemplary embodiment of the present inventive concept, the display apparatus may further include a data driver that may output a data voltage to the display panel. The signal comparing circuit may be disposed in the data driver.

In an exemplary embodiment of the present inventive concept, the comparison data may indicate whether the data lines are pre-charged or not and a voltage level of a pre-charge voltage.

In an exemplary embodiment of the present inventive concept, the pre-charge controller may include a plurality of pre-charge voltage applying switches electrically connected to a plurality of pre-charge voltage applying circuits configured to apply the plurality of pre-charge voltages having different voltage levels. A pre-charge start switch connects between each of the plurality of pre-charge voltage applying switches and the plurality of data lines.

In an exemplary embodiment of the present inventive concept, the display apparatus may further include a shift register that may control the plurality of pre-charge voltage applying switches based on the comparison data.

In an exemplary embodiment of the present inventive concept, the comparison data may be applied to the plurality of pre-charge voltage applying switches.

In an exemplary embodiment of the present inventive concept, the plurality of pre-charge voltage applying circuits may apply two pre-charge voltages having different voltage levels.

In an exemplary embodiment of the present inventive concept, the plurality of pre-charge voltage applying circuits may apply three pre-charge voltages having different voltage levels.

In an exemplary embodiment of the present inventive concept, the pre-charge controller may pre-charge the data lines based on a horizontal synchronization signal.

According to an exemplary embodiment of the present inventive concept, the display apparatus includes a display panel, a data driver and a pre-charge controller. The display panel may display an image and include a plurality of gate lines, a plurality of data lines and a plurality of pixels connected to the plurality of gate lines and the plurality of data lines. The data driver may generate a comparison data from a comparison of an image data of an image currently being displayed with an image data of an image to be displayed subsequently. The pre-charge controller may pre-charge the plurality of data lines with a predetermined voltage level based on the comparison data.

In an exemplary embodiment of the present inventive concept, the display apparatus may include a data driver. The data driver may include a first storage device, a second storage device and a third storage device. The first storage device may store the image data of the image currently being displayed. The second storage device may store the image data of the image to be displayed. The third storage device may store the comparison data.

In an exemplary embodiment of the present inventive concept, the display apparatus may include the pre-charge controller. The pre-charge controller may include a plurality of pre-charge voltage applying switches and a pre-charge start switch. The plurality of pre-charge voltage applying switches may be electrically connected to a plurality of pre-charge voltage applying circuits and may apply pre-charge voltages having different voltage levels. A pre-charge start switch may be connected between each of the plurality of pre-charge voltage applying switches and the plurality of data lines.

In an exemplary embodiment of the present inventive concept, the display apparatus may include a shift register that may control the pre-charge voltage applying switches based on the comparison data.

In an exemplary embodiment of the present inventive concept, the comparison data may be applied to the plurality of pre-charge voltage applying switches.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION OF THE EMBODIMENTS

Hereinafter, exemplary embodiments of the present inventive concept will be explained in detail with reference to the accompanying drawings.

Figure 1:
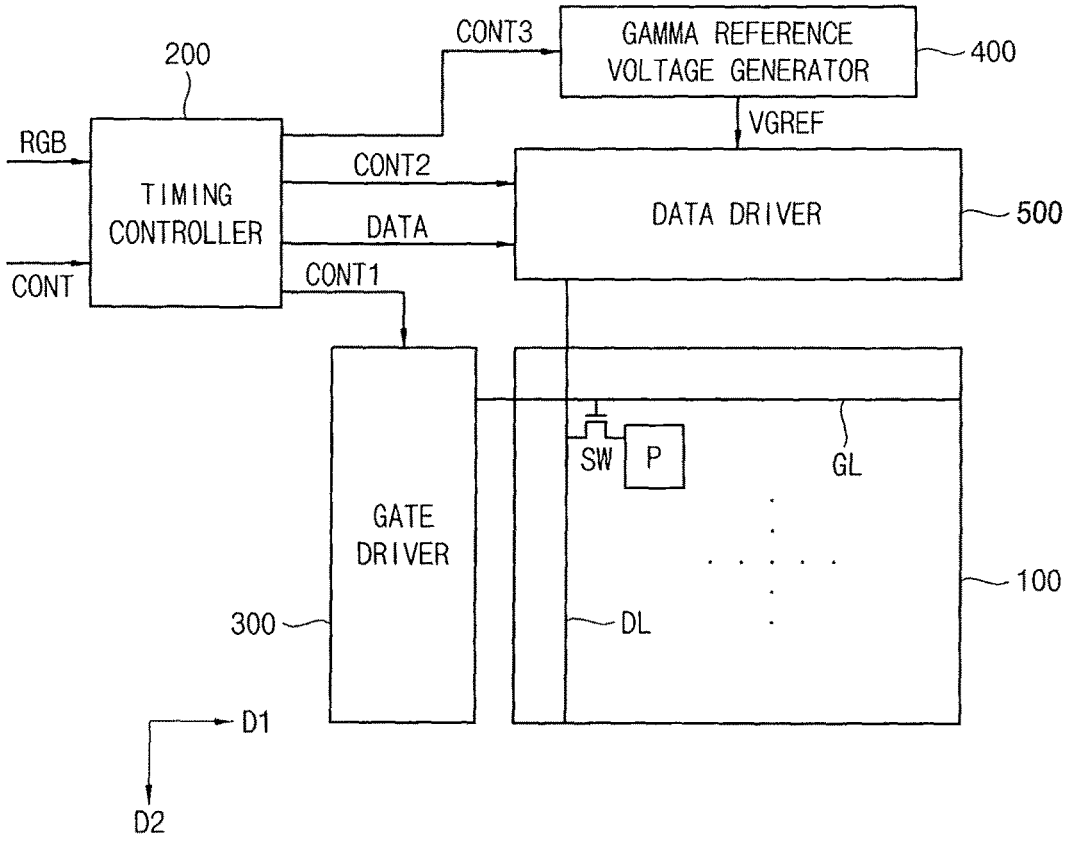
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 displays an image based on input image data. The display panel 100 has a display region on which the image is displayed and a peripheral region adjacent to the display region.

The display panel 100 includes a plurality of gate lines GL, a plurality of data lines DL and a plurality of sub-pixels P connected to the gate lines GL and the data lines DL. The gate lines GL extend in a first direction D1 and the data lines DL extend in a second direction D2 crossing the first direction D1. The first direction D1 may substantially perpendicular to the second direction D2.

Each sub-pixel P includes a switching element SW and a capacitor electrically connected to the switching element SW. The sub-pixels P may be disposed in a matrix form. For example, the switching element SW may be a thin film transistor.

For example, the display apparatus may be a liquid crystal display apparatus or an organic light emitting diode display apparatus. The present inventive concept may be applied to various display apparatuses which include thin film transistors.

The timing controller 200 receives the input image data RGB and an input control signal CONT from an external apparatus. The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates a data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be integrated on the peripheral portion of the display panel 100. Additionally, the gate driver 300 may be directly mounted on the display panel 100, or may be connected to the display panel 100 in a tape carrier package (TCP) type.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment of the present inventive concept, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be directly mounted on the display panel 100, or be connected to the display panel 100 in a TCP type. Additionally, the data driver 500 may be integrated in the display panel 100.

Figure 2:
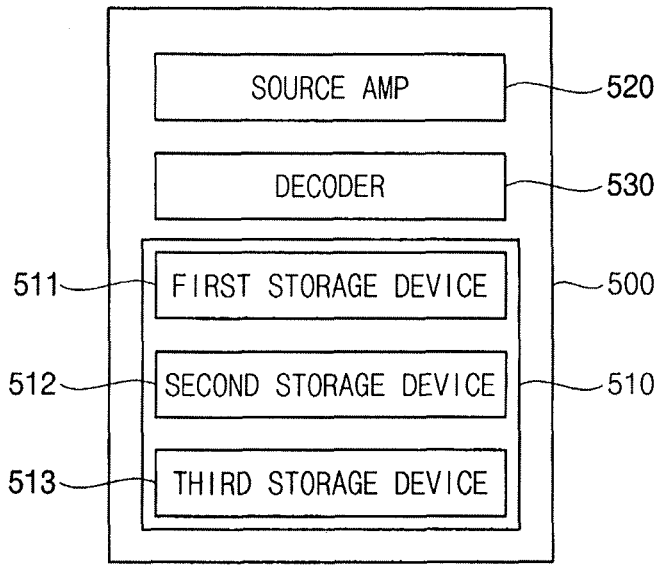
FIG. 2 is a block diagram illustrating a data driver of the display apparatus of FIG. 1 according to an exemplary embodiment of the present inventive concept.
Figure 3:
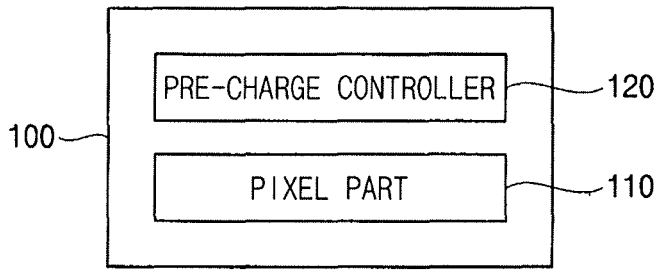
FIG. 3 is a block diagram illustrating a display panel of the display apparatus of FIG. 1 according to an exemplary embodiment of the present inventive concept.
Figure 4:
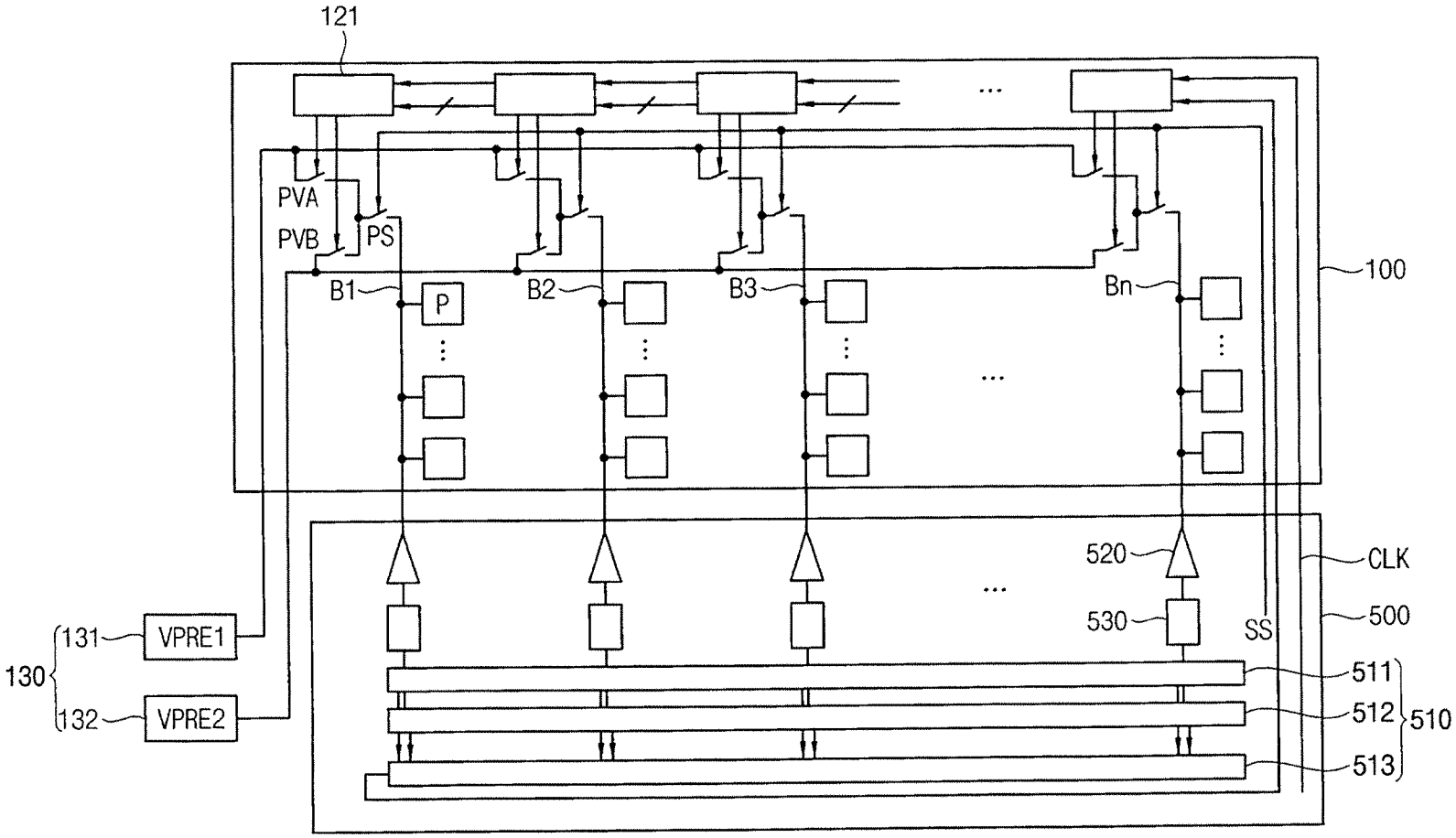
FIG. 4 is a circuit diagram illustrating a display panel and a data driver of a display apparatus according to an exemplary embodiment of the present inventive concept.

FIG. 2 is a block diagram illustrating a data driver of the display apparatus of FIG. 1 according to an exemplary embodiment of the present inventive concept. FIG. 3 is a block diagram illustrating a display panel of the display apparatus of FIG. 1 according to an exemplary embodiment of the present inventive concept. FIG. 4 is a circuit diagram illustrating a display panel and a data driver of a display apparatus according to an exemplary embodiment of the present inventive concept.

Referring to FIGS. 2 to 4, a display apparatus according to an exemplary embodiment of the present inventive concept includes a display panel 100 and a data driver 500 configured to output a data voltage to the display panel 100.

The data driver 500 includes a signal comparing part 510, e.g. a signal comparing circuit, a source amp 520 and a decoder 530. The signal comparing part 510 includes a first storage device 511, a second storage device 512 and a third storage device 513. The signal comparing part 510 may be disposed in the data driver 500.

The display panel 100 includes a pixel part 110 and a pre-charge controller 120. The pre-charge controller 120 includes a shift register 121, pre-charge voltage applying switches PVA and PAB and a pre-charge start switch PS.

A pre-charge voltage applying part 130, e.g. a pre-charge voltage applying circuit, is connected to the pre-charge controller 120. In the present exemplary embodiment, the pre-charge voltage applying part 130 includes a first pre-charge voltage applying part 131 and a second pre-charge voltage applying part 132. The first pre-charge voltage applying part 131 applies a first pre-charge voltage Vpre1 to the pre-charge controller 120. The second pre-charge voltage applying part 132 applies a second pre-charge voltage Vpre2 to the pre-charge controller 120. A level of the second pre-charge voltage Vpre2 may be higher than a level of the first pre-charge voltage Vpre1.

An image data corresponding to an image currently being displayed on the display panel 100 is stored in the first storage device 511. An image data corresponding to an image to be displayed subsequently on the display panel 100 is stored in the second storage device 512. The signal comparing part 510 compares the image data corresponding to the image currently being displayed with the image data corresponding to the images to be displayed subsequently. The result of the comparison between the image data stored in the first storage device 511 and the data stored in the second storage device 512, e.g. the comparison data, is stored in the third storage device 513.

The signal comparing part 510 compares levels of image data stored in the first and second storage devices 511 and 512 with levels of the first and the second pre-charge voltage Vpre1 and Vpre2 respectively. The signal comparing part 510 determines whether the data lines are pre-charged and the voltage level of a pre-charge voltage according to the result of the comparison.

The comparison data is provided to the pre-charge controller 120. In the present exemplary embodiment, the comparison data is provided to the shift register 121 of the pre-charge controller 120. One of the pre-charge voltage applying switches PVA and PVB may be closed according to the comparison data, and a pre-charge start signal SS is applied to the pre-charge controller 120. The pre-charge start signal SS controls a pre-charge start switch PS to pre-charge the data lines.

In an exemplary embodiment of the present inventive concept, the pre-charge voltage applying parts may include N pre-charge voltages applying parts. N is a natural number greater than one. Each of the N pre-charge voltages applying parts may apply a different pre-charge voltage VpreN to the pre-charge controller 120. The pre-charge controller 120 may include N pre-charge voltage applying switches PVN.

Figure 5:
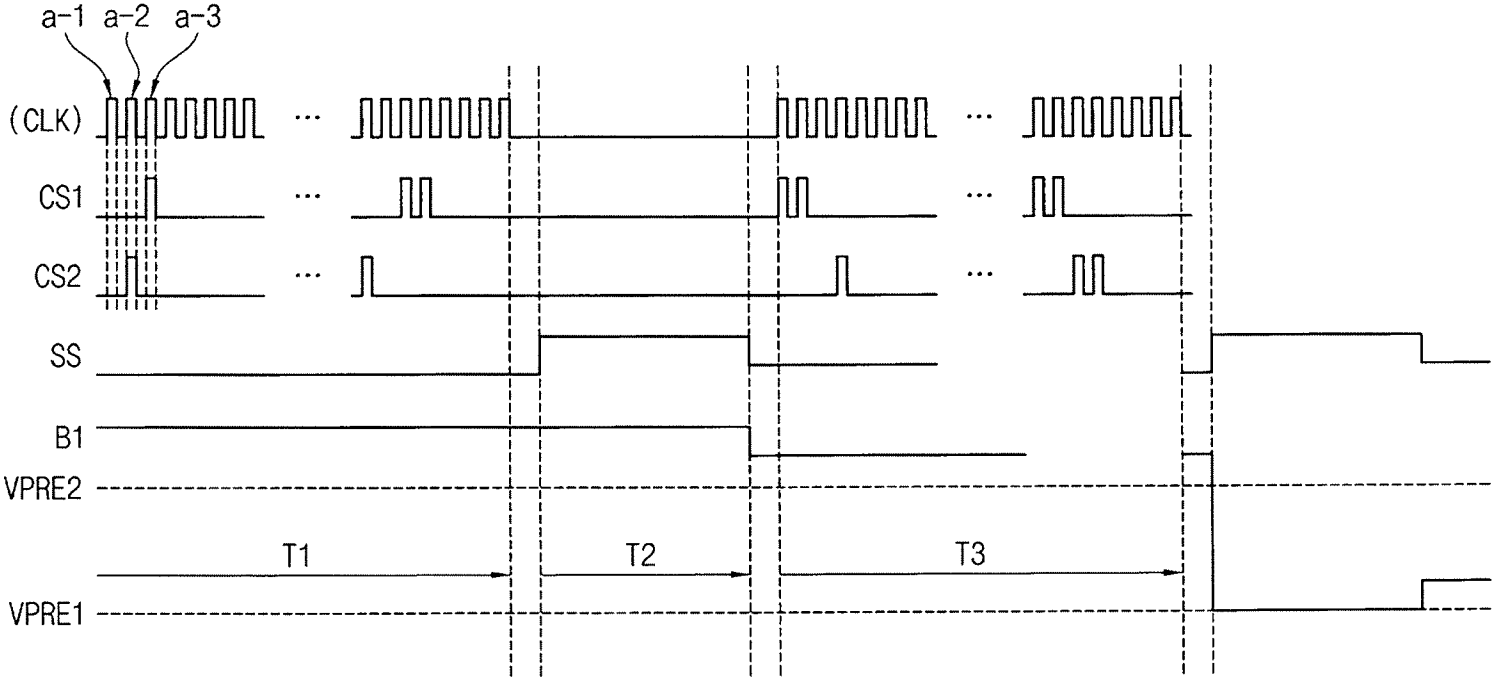
FIG. 5 is a waveform diagram illustrating a pre-charge voltage being used for a method of driving a display apparatus according to an exemplary embodiment of the present inventive concept.
Figure 6:
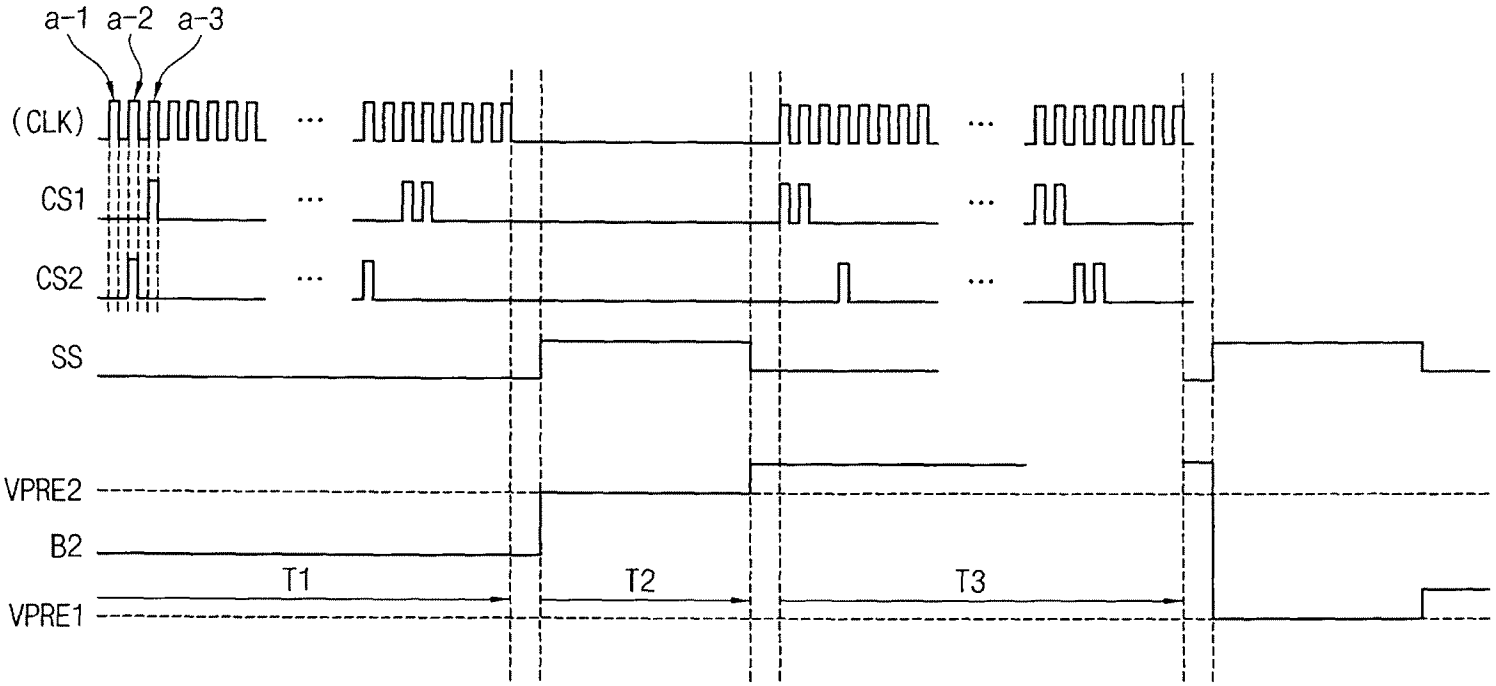
FIG. 6 is a waveform diagram illustrating a pre-charge voltage being used for a method of driving a display apparatus according to an exemplary embodiment of the present inventive concept.
Figure 7:
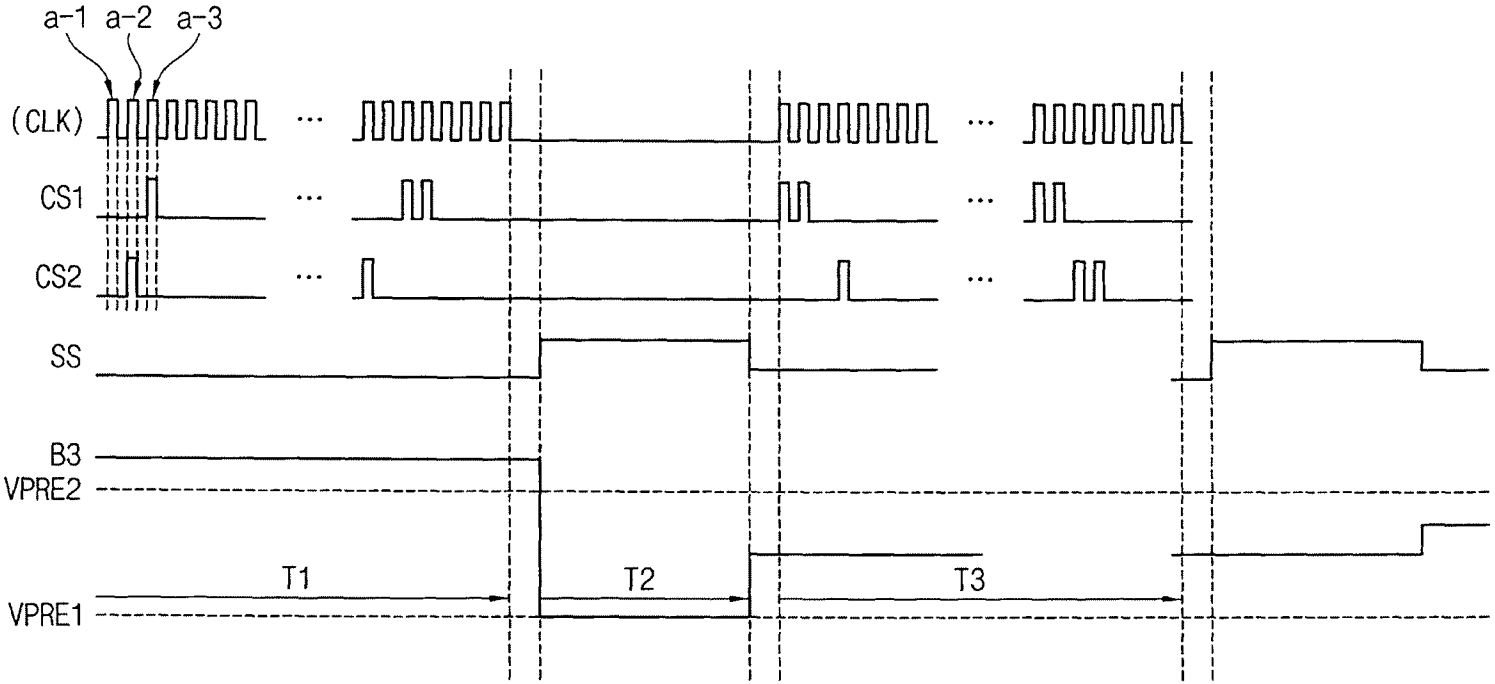
FIG. 7 is a waveform diagram illustrating a pre-charge voltage being used for a method of driving a display apparatus according to an exemplary embodiment of the present inventive concept.

FIG. 5 is a waveform diagram illustrating a pre-charge voltage being used for a method of driving a display apparatus according to an exemplary embodiment of the present inventive concept. FIG. 6 is a waveform diagram illustrating a pre-charge voltage being used for a method of driving a display apparatus according to an exemplary embodiment of the present inventive concept. FIG. 7 is a waveform diagram illustrating a pre-charge voltage being used for a method of driving a display apparatus according to an exemplary embodiment of the present inventive concept.

Referring to FIG. 4 and FIG. 5, a data line driving the display apparatus is pre-charged according to an exemplary embodiment of the present inventive concept.

A clock signal CLK, a first pre-charge voltage applying switch control signal CS1, a second pre-charge voltage applying switch control signal CS2 and a pre-charge start signal SS are applied to the shift register 121. T1 is a time for writing a data to the data lines. T2 is a time for performing a pre-charge of the data line. T3 is a time for writing a data to a next horizontal pixel line. The pre-charge of the data line is triggered by the horizontal synchronization signal.

During a section "a-1" of the clock signal CLK, the signal comparing part 510 determines whether a first data line B1 is pre-charged. In the section "a-1" of the clock signal CLK, the first pre-charge voltage applying switch control signal CS1 and the second pre-charge voltage applying switch control signal CS2 are logically "00". The logic value "00" indicates that the data line is not pre-charged. For example, when the image currently being displayed and the image to be displayed subsequently have voltage levels in substantially the same voltage range, the first pre-charge voltage applying switch control signal CS1 and the second pre-charge voltage applying switch control signal CS2 have a logic value "00". In a further example, a voltage level of the image currently being displayed and a voltage level of the images to be displayed subsequently are both higher than the second pre-charge voltage Vpre2. In this example, the data line is not pre-charged, and the decoder 530 and the source amp 520 write the new image data to the first storage device 511 and the data line.

Referring to FIG. 4 and FIG. 6, the data line driving the display apparatus is pre-charged by the second pre-charge voltage Vpre2 according to an exemplary embodiment of the present inventive concept.

A clock signal CLK, a first pre-charge voltage applying switch control signal CS1, a second pre-charge voltage applying switch control signal CS2 and a pre-charge start signal SS are applied to the shift register 121. T1 is a time for writing a data to the data lines. T2 is a time for performing a pre-charge of the data line. T3 is a time for writing a data to a next horizontal pixel line. The pre-charge of the data line is triggered by the horizontal synchronization signal.

At section "a-2" of the clock signal CLK, the signal comparing part 510 determines whether a second data line B2 is pre-charged. In the section "a-2" of the clock signal CLK, the first pre-charge voltage applying switch control signal CS1 and the second pre-charge voltage applying switch control signal CS2 have a logic value "01".

The logic value "01" indicates that the data line is pre-charged by the second pre-charge voltage Vpre2. For example, when the image currently being displayed and the image to be displayed subsequently have voltage levels in the different voltage range, the first pre-charge voltage applying switch control signal CS1 and the second pre-charge voltage applying switch control signal CS2 are logically "01". In a further example, a voltage level of the image currently being displayed is higher than the second pre-charge voltage Vpre2 and a voltage level of the image to be displayed subsequently is higher than the first pre-charge voltage Vpre1 and lower than the second pre-charge voltage Vpre2. In this example, the data line is pre-charged by the second pre-charge voltage Vpre2, and the decoder 530 and the source amp 520 write the new image data to the first storage device 511 and the data line.

Referring to FIG. 4 and FIG. 7, the data line driving the display apparatus is pre-charged by the first pre-charge voltage Vpre1 according to an exemplary embodiment of the present inventive concept.

A clock signal CLK, a first pre-charge voltage applying switch control signal CS1, a second pre-charge voltage applying switch control signal CS2 and a pre-charge start signal SS are applied to the shift register 121. T1 is a time for writing a data to the data lines. T2 is a time for performing a pre-charge of the data line. T3 is a time for writing a data to a next horizontal pixel line. The pre-charge of the data line is triggered by the horizontal synchronization signal.

During a section "a-3" of the clock signal CLK, the signal comparing part 510 determines whether a third data line B3 is pre-charged. In the section "a-3" of the clock signal CLK, the first pre-charge voltage applying switch control signal CS1 and the second pre-charge voltage applying switch control signal CS2 have a logic value "10". The logic value "10" indicates that the data line pre-charged to the first pre-charge voltage Vpre1. For example, when the image currently being displayed and the image to be displayed subsequently have voltage levels in the different voltage range, the first pre-charge voltage applying switch control signal CS1 and the second pre-charge voltage applying switch control signal CS2 have a logic value "10". In a further example, a voltage level of the image currently being displayed is higher than the first pre-charge voltage Vpre1 and lower than the second pre-charge voltage Vpre2 and a voltage level of the image to be displayed subsequently is higher than the second pre-charge voltage Vpre2. In this example, the data line is pre-charged by the first pre-charge voltage Vpre1, and the decoder 530 and the source amp 520 write the new image data to the first storage device 511 and to the data line.

Figure 8:
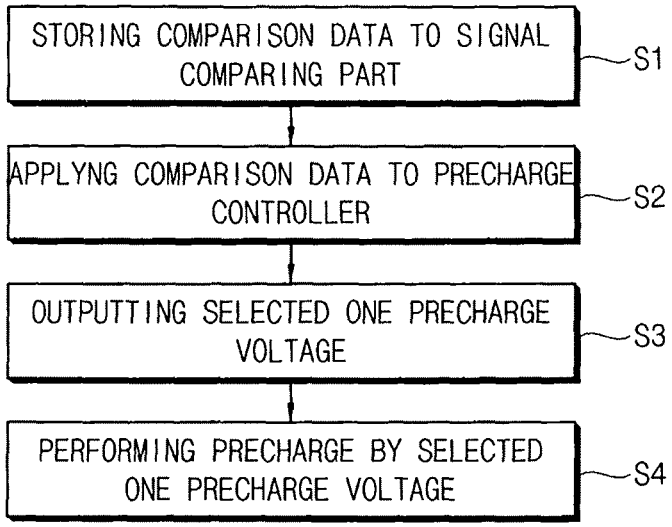
FIG. 8 is a block diagram illustrating a method of driving a display apparatus according to an exemplary embodiment of the present inventive concept.

FIG. 8 is a block diagram illustrating a method of driving a display apparatus according to an exemplary embodiment of the present inventive concept.

Referring to FIG. 8, a method of driving a display apparatus according to an exemplary embodiment of the present inventive concept includes comparing an image data of an image currently being displayed with an image data of an image to be displayed subsequently and to store a comparison data resulting from the comparison of the image data (S1). The comparison data is applied to the pre-charge controller (S2). A selected pre-charge voltage of a plurality of pre-charge voltages having different voltage levels is output (S3). In response to a pre-charge control signal, data lines are pre-charged using the selected pre-charge voltage (S4).

Comparing the image data of the image currently being displayed with an image data of the image to be displayed subsequently and storing a comparison data resulting from the comparison of the image data (S1) may include additional steps. The image data of the image currently being displayed may be stored in the first storage device 511. The image data of the image to be displayed subsequently may be stored in the second storage device 512. The image data stored in the first storage device 511 and the image data stored in the second storage device 512 may be compared. Comparison data resulting from the comparison of the image data is stored.

The signal comparing part 510 compares levels of the image data stored in the first and second storage devices 511 and 512 with levels of the first and the second pre-charge voltage Vpre1 and Vpre2 respectively. The signal comparing part 510 determines whether the data lines are pre-charged and voltage level of a pre-charge voltage according to the result of the comparison.

Applying the comparison data to the pre-charge controller (S2) includes providing the comparison data to the pre-charge controller 120. In the present exemplary embodiment, the comparison data is provided to the shift registers 121 of the pre-charge controller 120.

A selected pre-charge voltage of a plurality of pre-charge voltages having different voltage levels is output (S3). For example, the pre-charge voltage applying switches PVA and PVB control the output of the first pre-charge voltage Vpre1 and the second pre-charge voltage Vpre2 respectively. One of the pre-charge voltage applying switches PVA and PVB may be closed according to the comparison data.

In response to a pre-charge control signal, the data lines are pre-charged using the selected pre-charge voltage (S4). For example, a pre-charge start signal SS is applied to the pre-charge controller 120. The pre-charge start signal SS controls a pre-charge start switch PS to pre-charge of the data lines.

Figure 9:
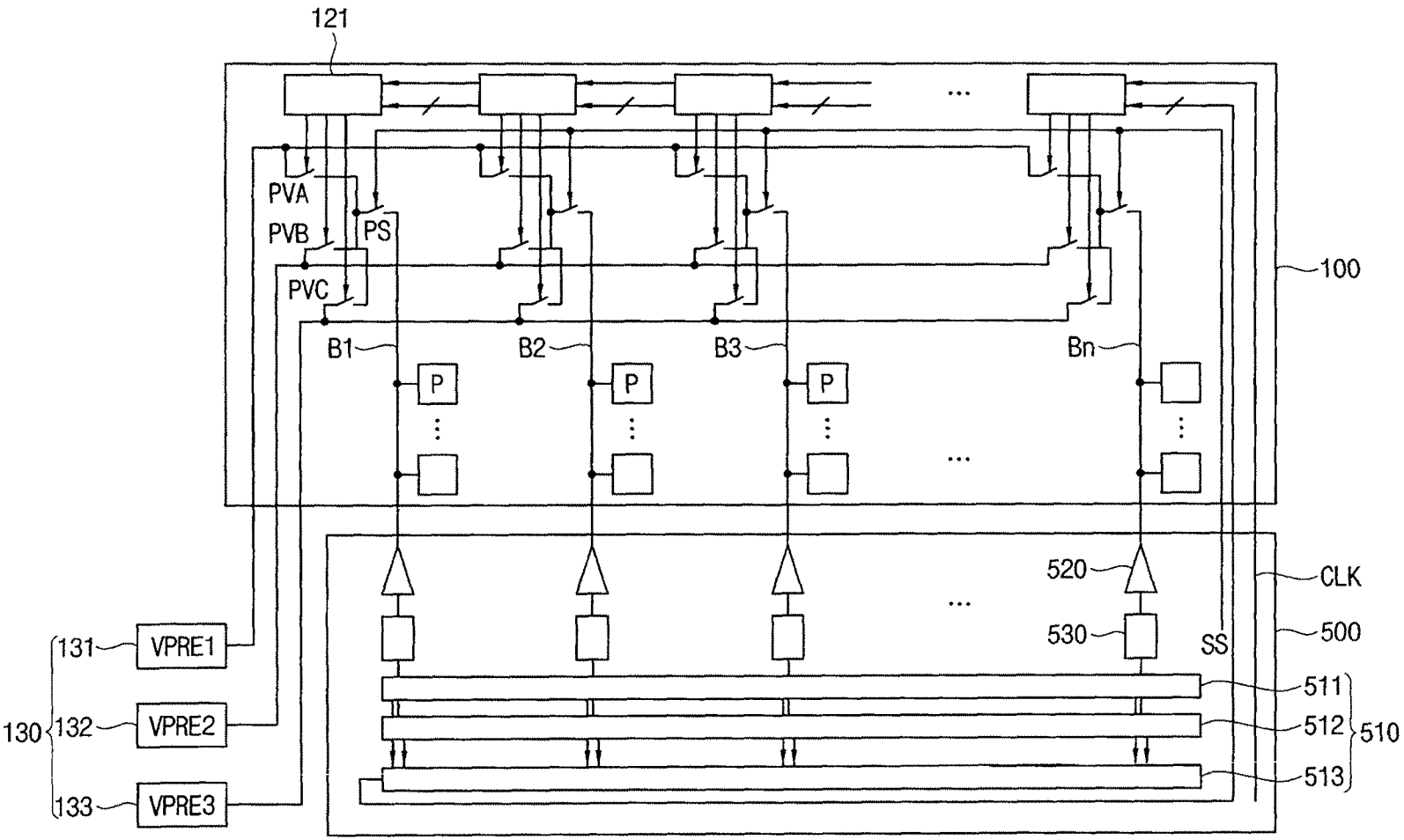
FIG. 9 is a circuit diagram illustrating a display panel and a data driver of a display apparatus according to an exemplary embodiment of the present inventive concept.

FIG. 9 is a circuit diagram illustrating a display panel and a data driver of a display apparatus according to an exemplary embodiment of the present inventive concept.

Referring to FIGS. 2, 3 and 9, a display apparatus according to an exemplary embodiment of the present inventive concept includes a display panel 100 and a data driver 500 configured to output a data voltage to the display panel 100.

The data driver 500 includes a signal comparing part 510, a source amp 520 and a decoder 530. The signal comparing part 510 includes a first storage device 511, a second storage device 512 and a third storage device 513. The signal comparing part 510 may be disposed in the data driver 500.

The display panel 100 includes a pixel part 110 and a pre-charge controller 120. The pre-charge controller 120 includes a shift register 121, pre-charge voltage applying switches PVA, PAB and PAC and a pre-charge start switch PS.

A pre-charge voltage applying part 130 is connected to the pre-charge controller 120. In the present exemplary embodiment, the pre-charge voltage applying part 130 includes a first pre-charge voltage applying part 131, a second pre-charge voltage applying part 132 and a third pre-charge voltage applying part 133. The first pre-charge voltage applying part 131 applies a first pre-charge voltage Vpre1 to the pre-charge controller 120. The second pre-charge voltage applying part 132 applies a second pre-charge voltage Vpre2 to the pre-charge controller 120. The third pre-charge voltage applying part 133 applies a third pre-charge voltage Vpre3 to the pre-charge controller 120. A level of the third pre-charge voltage Vpre3 may be higher than a level of the second pre-charge voltage Vpre2. In addition, a level of the second pre-charge voltage Vpre2 may be higher than a level of the first pre-charge voltage Vpre1.

An image data of the image currently being displayed on the display panel 100 is stored in the first storage device 511. An image data of the image to be displayed subsequently on the display panel 100 is stored in the second storage device 512. The signal comparing part 510 compares the image data of the image currently being displayed with the image data of the image to be displayed subsequently. A comparison data resulting from a comparison of the image data is stored in the third storage device 513.

The signal comparing part 510 compares levels of the image data stored in the first and second storage devices 511 and 512 with levels of the first pre-charge voltage Vpre1, the second pre-charge voltage Vpre2 and the third pre-charge voltage Vpre3 respectively. The signal comparing part 510 determines whether the data lines are pre-charged and voltage level of a pre-charge voltage according to the result of the comparison.

The comparison data is provided to the pre-charge controller 120. In the present exemplary embodiment, the comparison data is provided to the shift register 121 of the pre-charge controller 120. For example, one of the pre-charge voltage applying switches PVA, PVB and PVC may be closed according to the comparison data. A pre-charge start signal SS may be applied to the pre-charge controller 120 to control a pre-charge start switch PS. The pre-charge start switch PS controls the application of the pre-charge voltage to the data lines.

Figure 10:
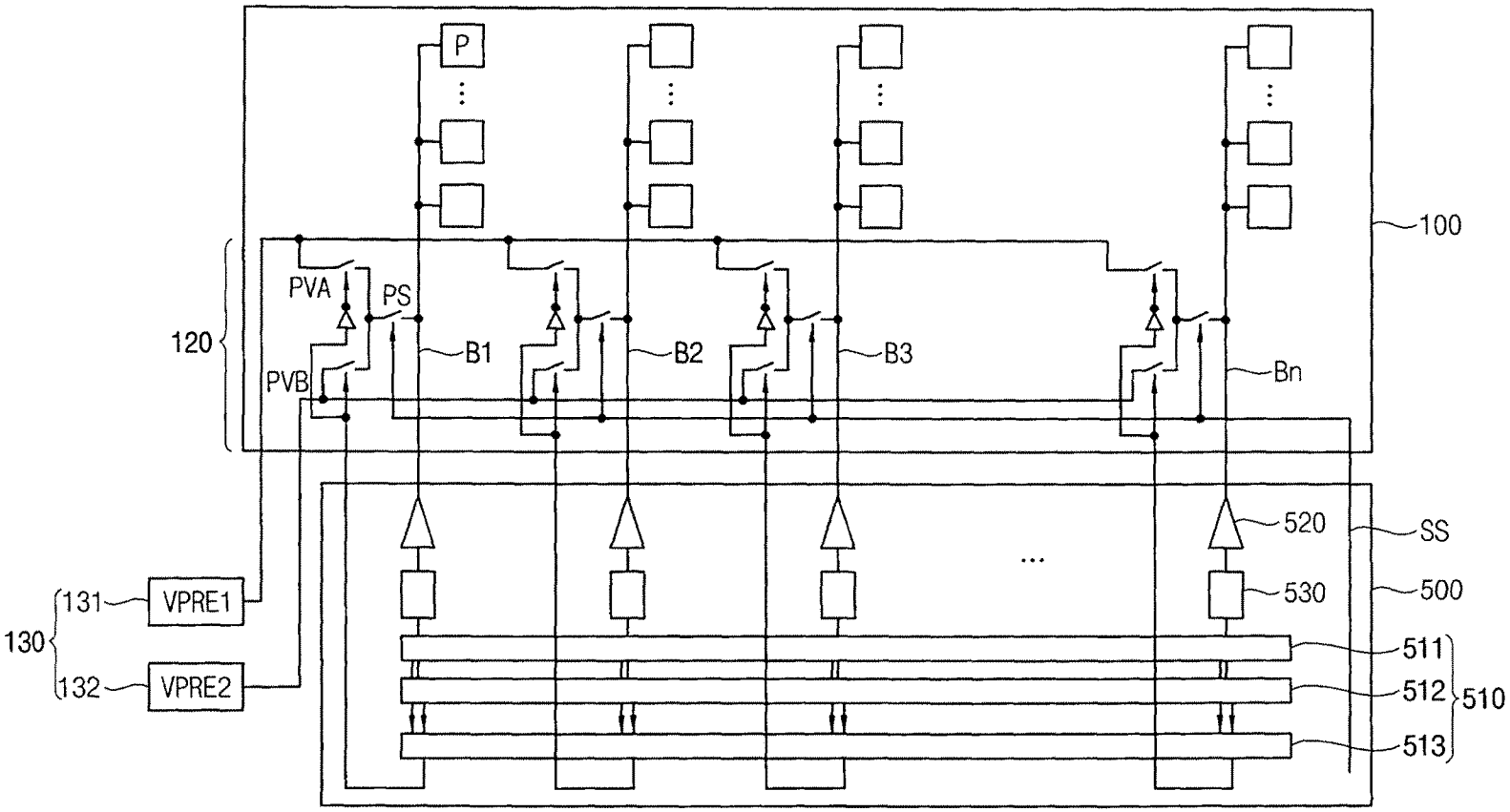
FIG. 10 is a circuit diagram illustrating a display panel and a data driver of a display apparatus according to an exemplary embodiment of the present inventive concept.

FIG. 10 is a circuit diagram illustrating a display panel and a data driver of a display apparatus according to an exemplary embodiment of the present inventive concept.

Referring to FIGS. 2 and 10, a display apparatus according to an exemplary embodiment of the present inventive concept includes a display panel 100 and a data driver 500 configured to output a data voltage to the display panel 100.

The data driver 500 includes a signal comparing part 510, a source amp 520 and a decoder 530. The signal comparing part 510 includes a first storage device 511, a second storage device 512 and a third storage device 513. The signal comparing part 510 may be disposed in the data driver 500.

The display panel 100 includes a pixel part 110 and a pre-charge controller 120. The pre-charge controller 120 includes pre-charge voltage applying switches PVA and PAB and a pre-charge start switch PS. In the present exemplary embodiment, a pre-charge controller 120 without shift register is disposed in the display panel 100.

A pre-charge voltage applying part 130 is connected to the pre-charge controller 120. In the present exemplary embodiment, the pre-charge voltage applying part 130 includes a first pre-charge voltage applying part 131 and a second pre-charge voltage applying part 132. The first pre-charge voltage applying part 131 applies a first pre-charge voltage Vpre1 to the pre-charge controller 120. The second pre-charge voltage applying part 132 applies a second pre-charge voltage Vpre2 to the pre-charge controller 120. A level of the second pre-charge voltage Vpre2 may be higher than a level of the first pre-charge voltage Vpre1.

An image data of the image currently being displayed on the display panel 100 is stored in the first storage device 511. An image data of the image to be displayed subsequently on the display panel 100 is stored in the second storage device 512. The signal comparing part 510 compares the image data of the image currently being displayed with the image data of the image to be displayed subsequently. A comparison data resulting from a comparison of the data is stored in the third storage device 513.

The signal comparing part 510 compares levels of image data stored in the first and second storage devices 511 and 512 with levels of the first and the second pre-charge voltage Vpre1 and Vpre2 respectively. The signal comparing part 510 determines whether the data lines are pre-charged and the voltage level of a pre-charge voltage according to the result of the comparison.

The comparison data is provided to the pre-charge controller 120. One of the pre-charge voltage applying switches PVA and PVB may be closed according to the comparison data. A pre-charge start signal SS is applied to the pre-charge controller 120 to control a pre-charge start switch PS. The pre-charge start switch PS controls the application of the pre-charge to the data lines.

According to the present exemplary embodiment, a display apparatus includes the pre-charge controller disposed in the display panel. A pre-charge of the data lines is performed through the pre-charge controller disposed in the display panel to reduce the voltage required to pre-charge the data lines by the data driver. Thus, a heating value of the data driver may be decreased.

A method of driving a display apparatus compares an image data of the image currently being displayed with an image data of the image to be displayed subsequently, and determines if the data lines is pre-charged. Thus, a power consumption of the display apparatus may be decreased.

While the present inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A display apparatus comprising:

a display panel configured to display an image, the display panel comprising a plurality of gate lines, a plurality of data lines and a plurality of pixels connected to the gate lines and the data lines;

a signal comparing circuit configured to compare, for each of N data lines among the plurality of data lines, image data of an image currently being displayed via charging the respective data line, with image data of an image to be displayed subsequently via again charging the respective data line, and store comparison data resulting from the comparison, where N is an integer of two or more; and a pre-charge controller disposed in the display panel and configured to pre-charge the data line with a predetermined voltage level having a value that is based on the comparison data, wherein the pre-charge controller comprises:

a plurality of pre-charge voltage applying switches electrically connected to a plurality of pre-charge voltage applying circuits configured to apply a plurality of pre-charge voltages having different voltage levels that are based on the comparison data; and a pre-charge start switch connected between each of the plurality of pre-charge voltage applying switches and the plurality of data lines.

2. The display apparatus of claim , wherein the signal comparing circuit comprises:

a first storage device configured to store the image data of the image currently being displayed;

a second storage device configured to store the image data of the image to be displayed subsequently; and a third storage device configured to store the comparison data concerning a result of a comparing of the image data stored in the first storage device and the second storage device as the comparison data.

3. The display apparatus of claim 2, further comprising:

a data driver configured to output a data voltage to the display panel;

wherein the signal comparing circuit is disposed in the data driver.

4. The display apparatus of claim 1, wherein the comparison data identifies whether the data lines are pre-charged or not and the voltage levels of the pre-charge voltages.

5. The display apparatus of claim 1, further comprising:

a shift register configured to output control signals that control the plurality of pre-charge voltage applying switches based on the comparison data.

6. The display apparatus of claim 1, wherein the comparison data is applied to the plurality of pre-charge voltage applying switches.

7. The display apparatus of claim 1, wherein the pre-charge voltage applying circuits applies two pre-charge voltages having different voltage levels.

8. The display apparatus of claim 1, wherein the pre-charge voltage applying circuits applies three pre-charge voltages having different voltage levels.

9. The display apparatus of claim 1, wherein the pre-charge controller pre-charges the data lines based on a horizontal synchronization signal.

10. The display apparatus of claim 1, wherein the pre-charge controller pre-charges the data line to the predetermined voltage level responsive to a pre-charge start signal and the comparison data.

11. A method of driving a display apparatus comprising a display panel configured to display an image and comprising a plurality of gate lines, a plurality of data lines and a plurality of pixels connected to the gate lines and the data lines, a signal comparing circuit, and a pre-charge controller disposed in the display panel, the method comprising:

comparing with the signal comparing circuit, for each of N data lines among the plurality of data lines, image data of an image currently being displayed via charging the respective data line with image data of an image to be displayed subsequently via again charging the respective data line, to generate comparison data, where N is an integer of two or more;

storing with the signal comparing circuit the comparison data;

applying the comparison data to the pre-charge controller;

outputting a selected pre-charge voltage having a value that is based on the comparison data, among a plurality of pre-charge voltages having different voltage levels; and pre-charging the respective data line by using the selected pre-charge voltage in response to a pre-charge control signal, wherein the pre-charge controller comprises:

a plurality of pre-charge voltage applying switches electrically connected to a plurality of pre-charge voltage applying circuits configured to apply the plurality of pre-charge voltages having different voltage levels that are based on the comparison data; and a pre-charge start switch connected between each of the plurality of pre-charge voltage applying switches and the plurality of data lines.

12. The method of claim 11, wherein the signal comparing circuit comprises:

a first storage device configured to store the image data of the image currently being displayed;

a second storage device configured to store the image data of the image to be displayed subsequently; and a third storage device configured to store a result of a comparing of the image data stored in the first storage device and the second storage device as the comparison data.

13. The method of claim 12, wherein the display apparatus further comprises:

a data driver configured to output a data voltage to the display panel;

wherein the signal comparing circuit is disposed in the data driver.

14. The method of claim 11, wherein the comparison data identifies whether the data lines are pre-charged or not and the voltage levels of the pre-charge voltages.

15. The method of claim 11, wherein the display apparatus further comprises:

a shift register configured to output control signals that control the plurality of pre-charge voltage applying switches based on the comparison data.

16. The method of claim 11, wherein the comparison data is applied to the plurality of pre-charge voltage applying switches.

17. The method of claim 11, wherein the plurality of pre-charge voltage applying circuits applies two pre-charge voltages having different voltage levels.

18. The method of claim 11, wherein the plurality of pre-charge voltage applying circuits applies three pre-charge voltages having different voltage levels.

19. The method of claim 11, wherein the pre-charge controller pre-charges the data lines based on a horizontal synchronization signal.

20. A display apparatus comprising:

a display panel configured to display an image, the display panel comprising a plurality of gate lines, a plurality of data lines and a plurality of pixels connected to the gate lines and the data lines;

a signal comparing circuit configured to compare image data of an image currently being displayed via charging a data line among the data lines, with image data of an image to be displayed subsequently via again charging the data line, and store comparison data resulting from the comparison; and a pre-charge controller disposed in the display panel and configured to pre-charge the data line with a predetermined voltage level having a value that is based on the comparison data, wherein, the comparison data is provided to the pre-charge controller at a first logic value, a second logic value or a third logic value;

if the comparison data is provided at the first logic value, no pre-charge is applied to the data line;

if the comparison data is provided at the second logic value, the data line is pre-charged at the predetermined voltage level set to a first voltage level; and if the comparison data is provided at the third logic value, the data line is pre-charged at the predetermined voltage level set to a second voltage level differing from the first voltage level.

* * * * *